United States Patent [19]

Nagashima et al.

[11] Patent Number: 4,646,611

[45] Date of Patent: Mar. 3, 1987

[54] ELECTRONIC MUSICAL INSTRUMENT

[75] Inventors: Yoichi Nagashima; Tatsunori Kondo; Kiyomi Takauji; Mineo Kitamura; Tadashi Matsushima; Eiji Nagashima; Masafumi Mizoguchi, all of Shizuoka, Japan

[73] Assignee: Kabushiki Kaisha Kawai Gakki Seisakusho, Japan

[21] Appl. No.: 680,944

[22] Filed: Dec. 12, 1984

[30] Foreign Application Priority Data

Dec. 13, 1983 [JP] Japan ..... 58-234653

[51] Int. Cl.[4] ..... G10H 1/02

[52] U.S. Cl. ..... 84/1.19; 84/DIG. 9; 84/1.21; 84/1.11

[58] Field of Search ..... 84/DIG. 9, 1.19, 1.11, 84/1.21

[56] References Cited

U.S. PATENT DOCUMENTS

| | | | |
|---|---|---|---|
| 3,821,461 | 6/1974 | Mieda | 84/DIG. 9 |
| 4,044,642 | 8/1977 | Pearlman et al. | 84/1.19 |
| 4,114,498 | 9/1978 | Chibana et al. | 84/1.19 |

*Primary Examiner*—S. J. Witkowski
*Assistant Examiner*—David Warren
*Attorney, Agent, or Firm*—McGlew and Tuttle

[57] ABSTRACT

An electronic musical instrument is provided with a temporal variation circuit of SCF parameters for temporally varying the filter characteristic of a switched capacitor filter circuit, a control circuit for digitally controlling the temporal variation circuit and a touch response circuit for detecting, by scanning, touch response data in performance, whereby temporal variations of a musical waveform signal are digitally controlled.

4 Claims, 16 Drawing Figures

ELECTRONIC MUSICAL INSTRUMENT

BACKGROUND OF THE INVENTION

1. Field of the Invention

The present invention relates to an electronic musical instrument adapted for digitally changing a musical waveform with time and in accordance with a touch response through utilization of a switched capacitor filter circuit for controlling a harmonic component of a source waveform signal in accordance with a desired timbre.

2. Description of the Prior Art

Conventionally, a musical tone generation system for electronic musical instruments is roughly divided into an analog sound source system and a digital sound source system, which respectively have merits and demerits. The digital sound source system permits synthesization of a musical waveform element by digital calculations, and hence is capable of producing timbre over a wide range, but since it posseses the defects of an enormous circuit scale and limitations imposed on the synthesization of timbre by the amount of calculation and the time therefor, it is employed only in some high-grade models. On the other hand, the analog sound source system comprises a source waveform generator for generating a source waveform signal corresponding to a note frequency and containing harmonic components in abundance, a filter circuit for controlling the harmonic components of the source waveform signal in accordance with a timbre desired to produce and an envelope generator for generating a desired envelope. These circuits have undergone various improvements as well-known VCO (Voltage Controlled Oscillator), VCF (Voltage Controlled Filter) and VCA (Voltage Controlled Amplifier) which employ voltage as a common control parameter. Further, many proposals have been made on digital control of electronic musical instruments through utilization of digital electronic circuit technologies typified by the microcomputer technology. For example, in the source waveform generator, the pitch corresponding to a note frequency is obtained with high accuracy by DCO (Digital Control Oscillator) using a "program counter". Moreover, storage and display of timbre setting data on the control panel, instantaneous modification of may musical parameters and simultaneous control of a plurality of channels by time-shared operations can also e achieved easily by the employment of the microcomputer technology.

However, many problems have been pointed out in connection with the digitization of an electronic musical instrument of the conventional analog sound source system. For instance, the VCF (Voltage Controlled Filter) could have been constructed at a low cost since it is necessary only to supply voltage of a volume specified on the control panel, but the supply of data via the microcomputer involves an A/D conversion and a D/A conversion, and hence calls for a very complex circuit arrangement. Further, in order to digitize control of an EG (Envelope Generator) for generating a control voltage which is supplied to the VCF to obtain temporal variations of timbre, it is necessary to supply the voltage after D/A converting it for each of such parameters as A (Attack), D (Decay), S (Sustain) and R (Release). This requires a large-scale circuit arrangement and analog fine control (offset control). Besides, in view of the characters of circuit parts forming the VCF, it is very difficult to employ an analog LSI in which a large-scale circuit is formed on one chip, and the manufacturing costs also present a problem.

SUMMARY OF THE INVENTION

It is therefore an object of the present invention to provide an electronic musical instrument of the analog sound source system which can be fabricated as an LSI and whose filter portion is digitized through the use of an SCF (Switched Capacitor Filter) circuit which is a digitally controllable analog signal filter.

Briefly stated, the electronic musical instrument of the present invention is provided with a temporal variation circuit of SCF parameters for temporally changing the filter characteristic of the switched capacitor filter, a control circuit for digitally controlling the temporal variation circuit and a touch response circuit for detecting, by scanning, touch response data in performance, whereby temporal variations in a musical waveform signal are digitally controlled.

DESCRIPTION OF THE PREFERRED EMBODIMENTS

With reference to the drawings, embodiments of the present invention will hereinafter be described in detail.

Figure 1:
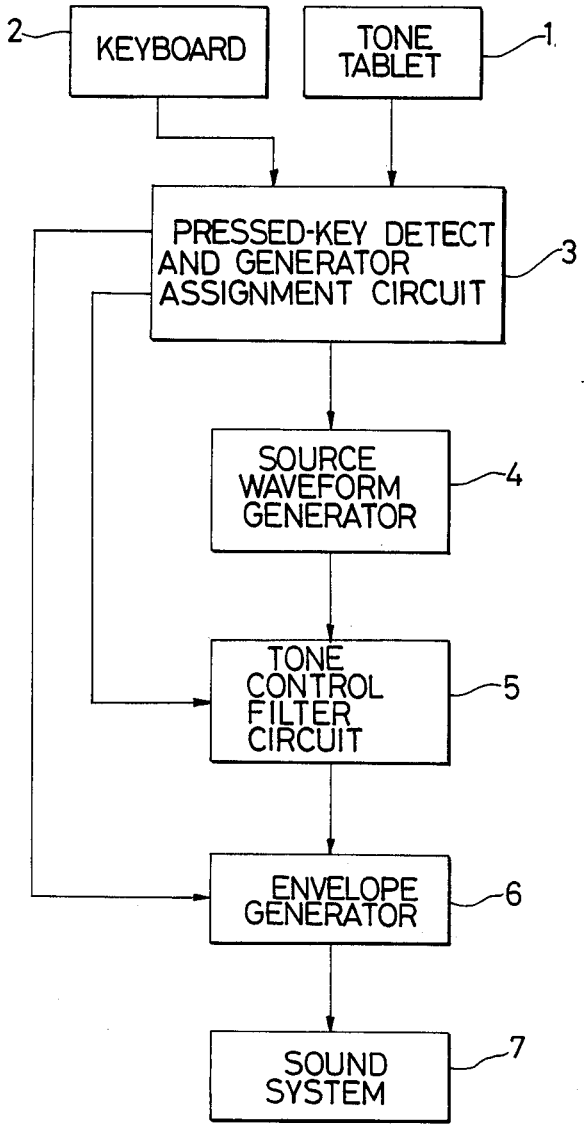
FIG. 1 is a block diagram illustrating the general arrangement of the electronic musical instrument of the present invention.

FIG. 1 illustrates in block form the general arrangement of the electronic musical instrument of the present invention. In FIG. 1, reference numeral 1 indicates a tone tablet; 2 designates a keyboard; 3 identifies a pressed-key detect and generator assignment circuit; 4 denotes a source waveform generator; 5 represents a tone control filter circuit; and 6 shows an envelope generator.

In response to timbre data and performance data entered from the keyboard 1 and the tone tablet 2 the pressed-key detect and generator assignment circuit 3 applies control signals to the associated circuits. The source waveform generator 4 responds to the performance data and the timbre data from the pressed-key detect and generator assignment circuit 3 to generate a source waveform signal corresponding to a note frequency. The output of the circuit 3 is provided to the tone control filter circuit 5 via a simple low-pass filter for cutting off a turn-back noise resulting from an operation of a switched capacitor filter. As a result of this, a desired timbre configuration and timbre variation are set in the tone control filter circuit 5. The envelope generator 5 sets amplitude modulation data such as the rise and fall and an envelope characteristic of each musical sound in accordance with the performance data from the presesd-key detect and generator assignment circuit 3. The analog signal output from the envelope generator 6 is provided to a sound system 7 including an "Effect" circuit, an amplifier and a speaker.

Figure 2:
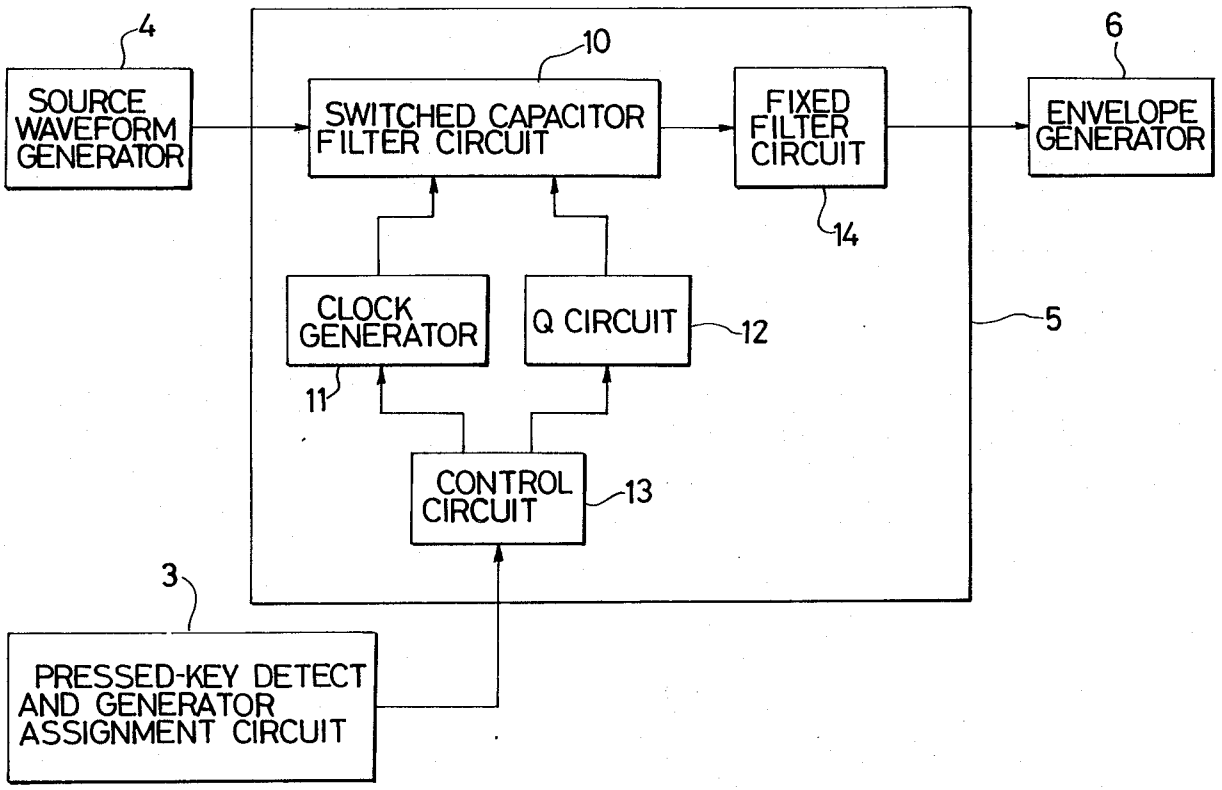
FIG. 2 is a block diagram showing, by way of example, a switched capacitor filter circuit and its peripheral control circuits which constitute a tone control filter circuit 5 utilized in FIG. 1.

FIG. 2 illustrates in block form a specific example of the arrangement including a switched capacitor filter circuit and control circuits associated therewith which constitute the tone control filter circuit 5 shown in FIG. 1. Reference numeral 10 indicates a switched capacitor filter circuit; 11 designates a clock generator for generating a clock signal for setting the cut-off frequency of the switched capacitor filter circuit 10; 12 identifies a Q circuit for setting Q character data of the switched capacitor filter circuit 10; 13 denotes a control circuit for temporally changing parameters of the clock generator 11 and the Q circuit; and 14 represents a fixed filter circuit for cutting off sampling noise which occurs in the switched capacitor filter circuit 10.

When supplied with rise and fall data on a musical signal from the pressed-key detect and generator assignment circuit 3, the control circuit 13 supplies the clock generator 11 and the Q circuit 12 with digital data corresponding to the temporal variations of the musical signal in a sequential order. The clock signal avaiable which from the clock generator 11 is to set the cut-off frequency of the switched capacitor filter circuit 10, and corresponds to a VCF envelope signal in the conventional VCF type electronic musical instrument. In the present invention, however, by batch-processing the pressed-key detect and generator assignment circuit 3 and the control circuit 13 by a CPU on a time-shared basis, a desired filter operation can be set under the control of a program. Consequently, according to the present invention, a timbre operation with a high degree of freedom can be achieved with a simpler arrangement than in the case of the conventional VCF type electronic musical instrument which requires an exclusive VCF envelope signal generator. The Q circuit 14 yields a control signal for selecting analog parameters which constitute the switched capacitor filter. For example, by selectively switching a plurality of resistors and circuit connecitons, the Q character data of the filter, which are of importance to the timbre operation, are selectively set. Accoridng to the present invention, it is possible to implement the tone control filter circuit 5 as a monolithic LSI after forming the clock genrator 11, the Q circuit 12 and the control circuit 13 by hardware. This is a great advantage over the prior art VCF type electronic musical instrument needs a large number of parts and hence is expensive.

Figure 3A:
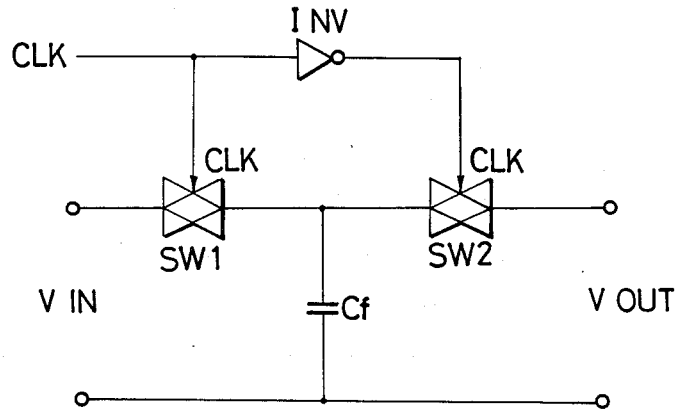
FIGS. 3A and 3B are circuit diagrams explanatory of the operational principles of a switched capacitor circuit forming the switched capacitor filter circuit 10 in FIG. 2.

FIGS. 3A and B show circuit diagrams explanatory of the principles of operation of a switched capacitor circuit forming the switched capacitor filter circuit 10 in FIG. 2. In FIG. 3(A), reference character Cf indicates a capacitor which assumes a major role in the circuit operation, and SW1 and SW2 designate transmission gate switches formed by MOS transistors, respectively. The switch SW1 is supplied with an input clock signal CLK, whereas the switch SW2 is driven, in the opposite phase, by a clock signal into which the input clock signal is inverted by an inverter circuit Inv. The amount of charge ΔQ which is transferred from the input side to the output side in one period of the input clock signal CLK can be expressed as follows:

$$\Delta Q = Cf(Vin - Vout) \ldots \quad (1)$$

where Vin and Vout are potentials at the input and output sides, respectively. Consequently, a mean current I which flows from the input side to the output side during one period of the input clock signal CLK becomes as follows:

$$I = \Delta Q/T = Cf(Vin - Vout)/T \ldots \quad (2)$$

Figure 3B:
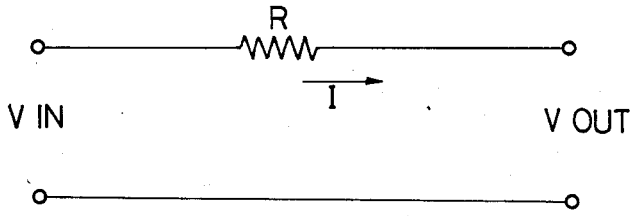

On the other hand, current I which flows from the input side to the output side via a resistor R in FIG. 3(B) is as follows:

$$I = (Vin - Vout)/R \ldots \quad (3)$$

For the sufficiently short period T, if the switched capacitor circuit of FIG. 3(A) is expressed as the equivalent resistor R of FIG. 3(B), it follows from expressions (2) and (3) that $$Cf(Vin - Vout)/T = (Vin - Vout)/R \therefore R = T/Cf \ldots \quad (4)$$

Generally, a parameter which determines the charactristics of a CR active filter circuit, such as a cut-off frequency and so on, is a time constant which is expressed by the product of C and R:

$$1/CR \ldots \quad (5)$$

Here, if the switched capacitor circuit of FIG. 3(A) is applied, as the equivalent resistor R of FIG. 3(B), to expression (5), then it follows that $$1/(C \cdot (T/Cf)) = Cf/(C \cdot T) = F \cdot (Cf/C) \ldots \quad (6)$$

where F is the clock frequency of the input clock signal CLK. The time constant depends upon the input clock frequency and the ratio between the electrostatic capacities of two capacitors used in the switched capacitor circuit and the acitve filter circuit. In the fabrication of a monolithic LSI, it is very difficult to set absolute values of the electrostatic capacities of individual capacitors within the accuracy of an analog filter. But since the ratio of electrostatic capacity between two capacitors, that is, the relative accuracy, as shown by expression (6), can easily be kept to about 1%, practical filter characteristics can be obtained with the switched capacitor filter circuit. Further, according to expression (6), the time constant can be determined by controlling such a digital quantity as the input clock frequency. The electrostatic capacities of the capacitors can be fixed constant only by setting their relative ratio in such small capacities that can be adopted on the monolithic LSI.

By employing the switched capacitor filter circuit which is used as a component of the CR active filter circuit, as described above, an analog filter of high accuracy, which has been very difficult to obtain in the past, can be implemented as a circuit which is possible of digital control and fabrication as an LSI.

Figure 4:
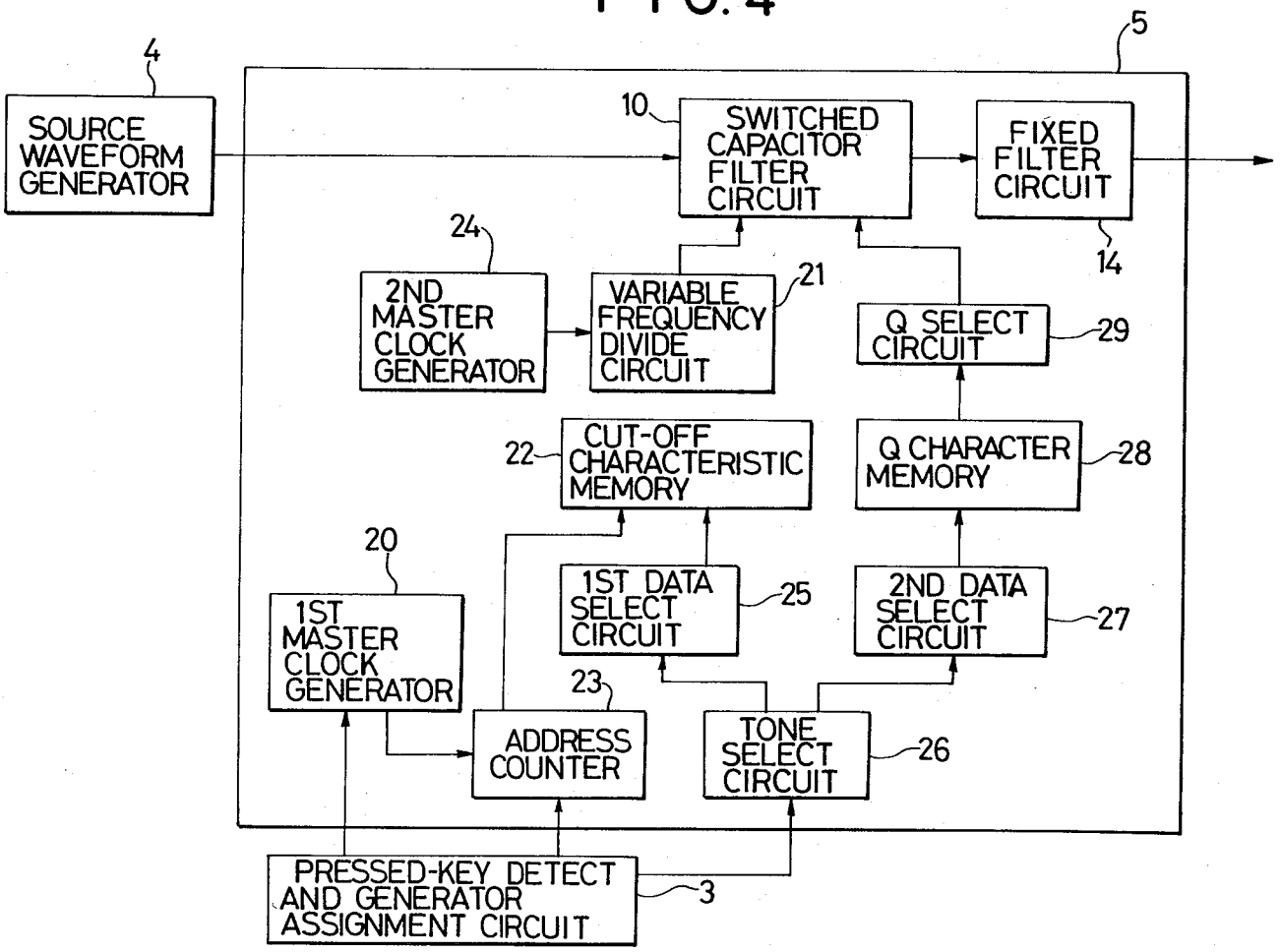
FIG. 4 is a block diagram illustrating a specific operative example of the circuit arrangement of the control circuits associated with the switched capacitor filter circuit 10 in FIG. 2.

FIG. 4 illustrates a specific example of the arrangement of control cirucits associated with the switched capacitor filter circuit depicted in FIG. 2. In FIG. 4, reference numeral 10 indicates a switched capacitor filter circuit; 14 designates a fixed filter circuit for cutting off sampling noise generated in the switched capacitor filter circuit 10; 20 identifies a first master clock generator; 11 denotes a variable frequency divide circuit; 22 represents a cut-off characteristic memory; 23 shows an address counter; 24 referes to a second master clock generator; 25 signifies a first data select circuit; 26 indicates a tone select circuit; 27 designates a second data select circuit; 28 identifies a Q character memory; and 29 denotes a Q select circuit.

Figure 5A:
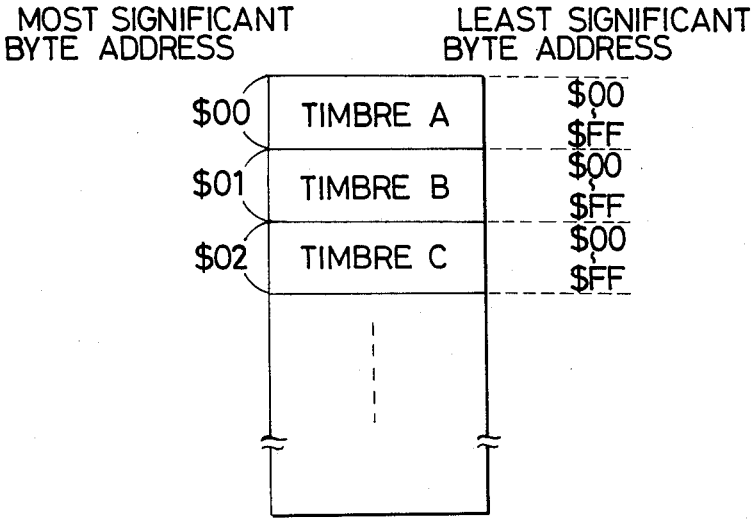
FIGS. 5A–C show a memory arrangement and graphs explanatory of the operation of the embodiment shown in FIG. 4.
Figure 5B:
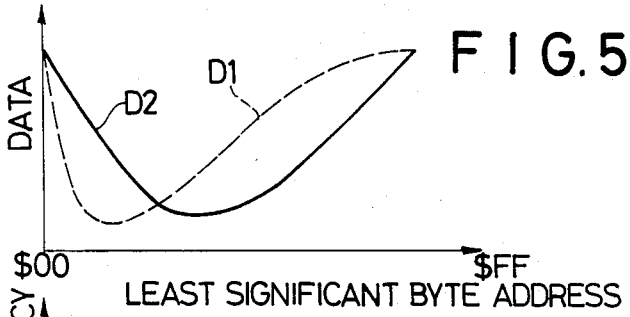
Figure 5C:
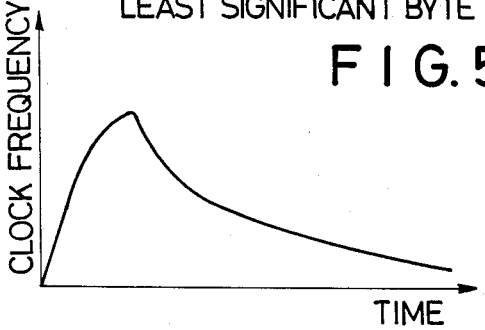

A description will be given, with reference to FIGS. 5A–5C, of the operation of the circuit arrangement shown in FIG. 4. The pressed-key detect and generator assignment circuit 3 supplies the tone select circuit 26 with timbre setting data including temporal variations. The tone select circuit 26 provides timbre setting selection data to the first data select circuit 25, by which is sepcified a data block of the cut-off characteristic memory 22. The cut-off characteristic memory 22 has an arrangement such, for example, as shown in FIG. 5(A). The storage area of the memory 22 is divided by high-order addresses from the first data select circuit 25 into timbre blocks, each of which has stored therein an amount of data corresponding to common low-order addresses. In accordance with a temporal variation speed parameter which is set by the pressed-key detect and generator assignment circuit 3, the first master clock generator 20 supplies the address counter 23 with a fixed master clock signal which forms the basis of temporal variations of timbre. The address counter 23 is initialized by a tone generation start signal (KEY-ON signal) from the pressed-key detect and generator assignment circuit 3, and generates an address signal which is incremented by the clock signal from the first master clock generator 20 and provides the address signal as the low-order address to the cut-off characteristic memory 22. The cut-off characteristic memory 22 has stored therein data, for instance, as shown in FIG. 5(B). That is, the memory 22 has prestored therein at the common low-order addresses cut-off characteristic data corresponding to individual temporal variations of each timbre, as indicated by D1, D2, . . . in FIG. 5(B). The memory 22 can be formed by a ROM, and if necessary, it is also possible to employ a RAM and to store therein data by calculating it with a CPU at any time. Data accessed by the high- and low-order addresses in the cut-off characteristic memory 22 is supplied to the variable frequency divide circuit 21. The variable frequency divide circuit 21 generates a clock signal for setting the cut-off frequency of the switched capacitor filter circuit 10. The variable frequency divide circuit 21 can be constituted by a well-known circuit such as a programmable counter circuit, a rate multiplier circuit or the like. In this case, however, as will be seen from FIG. 3, it is desirable that the clock signal by the switched capacitor filter circuit have a duty of 50%, and it is required to apply it to the frequency divide circuit, as required. In the second master clock generator 24 which provides a master clock signal to the frequency divide circuit 21, it is effective to set the clock frequency as high as possible to satisfy the requirements that the clock signal for setting the cut-off frequency be set sufficiently high in frequcncy for avoiding the turn-back noise generation and that the frequency range of the clock signal which is selectively produced by the frequency divide circuit 21 be set sufficiently wide. FIG. 5(C) shows an example of the output clock signal of the variable frequency divide circuit 21. As will be seen form FIG. 5(C), the clock signal for setting the cut-off frequency of the switched capacitor filter circuit 10 varies with the lapse of time, implementing the timbre operation corresponding to the operation of the voltage controlled filter in the conventional electronic musical instrument. In the case of the prior art analog VCF system, it is possible to obtain only timbre variations within the range of the circuit characteristic of the envelope generator which generates the temporal variation parameter. In contrast thereto, according to the present invention, it is possible to arbitrarily enlarge and reduce the time axis by the first master clock generator 20, to set a desired temporal variation pattern by the cut-off characterisic memory 22 and to produce, with ease, such a periodic timbre variation as a wow-wow effect according to the access or clear method of the address counter 23. Therefore, the present invention is capable of producing richer musical sounds than does the conventional electronic musical instrument.

Figure 6:
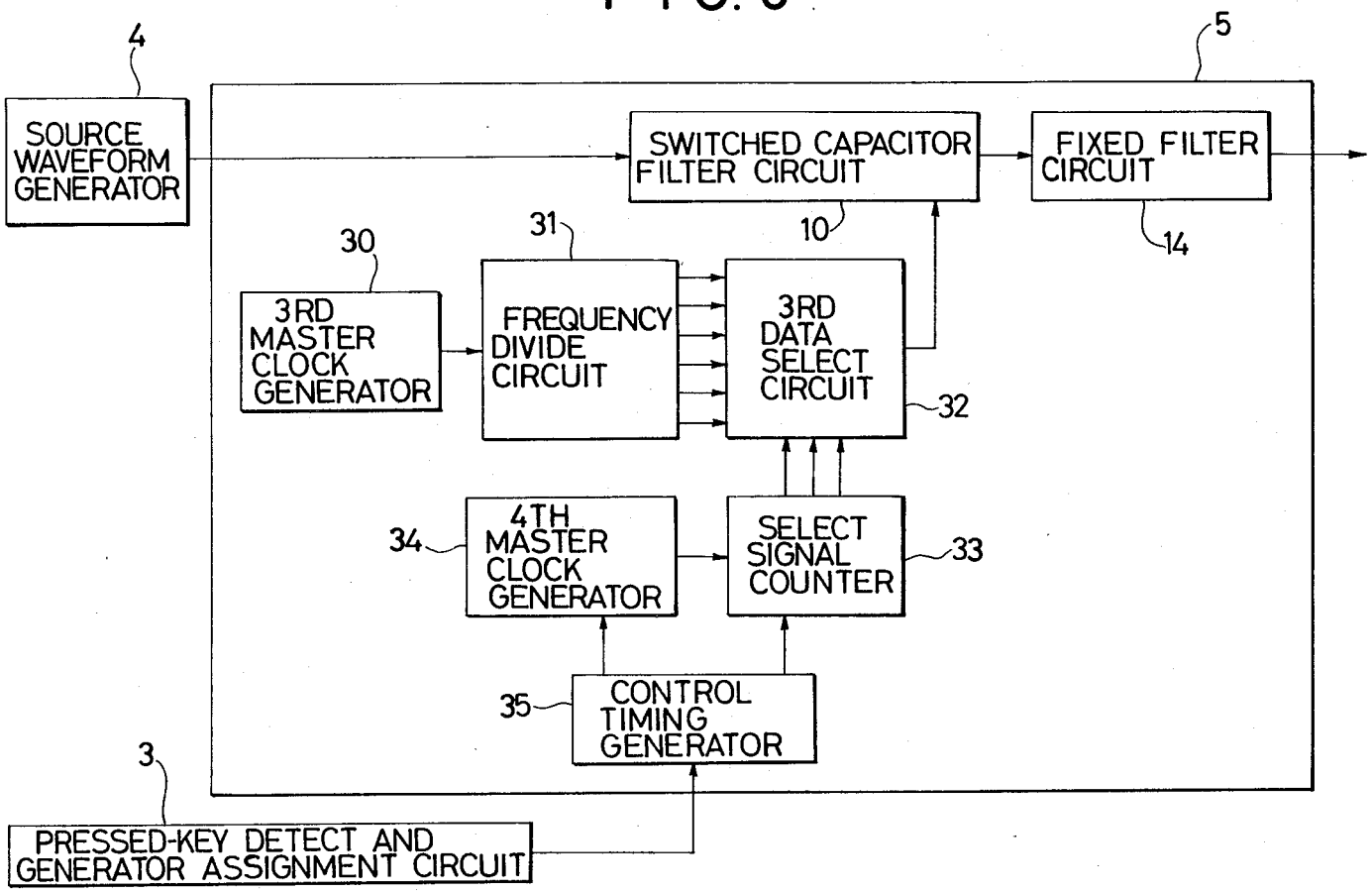
FIG. 6 is a block diagram illustrating another specific example of the circuit arrangement of the control circuits associated with the switched capacitor filter circuit shown in FIG. 2.

FIG. 6 illustrates another example of the specific arrangement of the control circuits associated with the switched capacitor filter circuit shown in FIG. 2. In FIG. 6, reference numeral 10 indicates a switched capacitor filter circuit; 14 designates a fixed filter circuit for cutting off sampling noise which is generated in the switched capacitor filter circuit 10; 30 identifies a third master clock generator; 31 denotes a frequency divide circuit; 32 represents a third data select circuit; 33 shows a select signal counter; 34 refers to a fourth master clock generator; and 35 signifies a control timing generator.

Figure 7A:
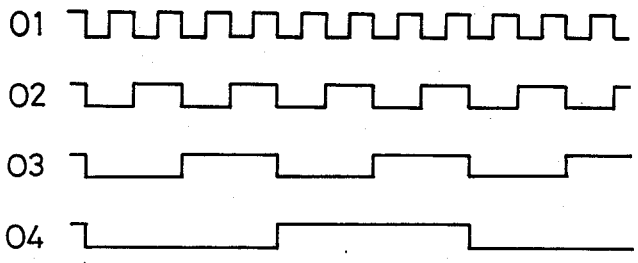
FIGS. 7A–C show diagrams explanatory of the operation of the embodiment depicted in FIG. 6.
Figure 7B:
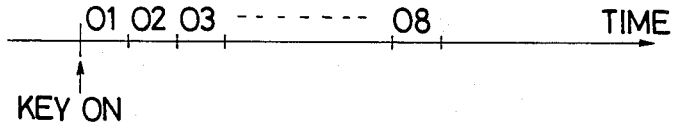
Figure 7C:
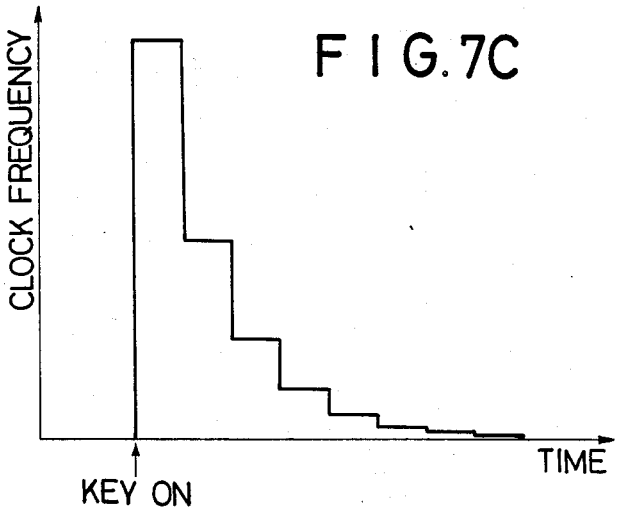

A description will be given, with reference to FIGS. 7A–C, of the operation of the embodiment shown in FIG. 6. The pressed-key detect and generator assignment circuit 3 supplies the control timing generator 35 with timbre setting data on the speed of the temporal variation. The fourth master clock generator 34, which is supplied with a necessary control signal from the control timing generator 35, yields a master clock signal for the select signal coutner 33. On the other hand, the third master clock generator 30 generates a master clock signal of a sufficiently high frequency which corresponding to the clock signal for setting the cut-off frequency of the switched capacitor filter circuit 10. The master clock signal from the fourth master clock generator 34 is provided to the frequency divide circuit 31. The frequency divide circuit 31 is formed by, for example, eight stages of cascade-connected binary counters, and outputs 01, 02, . . . and 08 of the respective stages each have an output frequency equal to one-half that of the preceding stage. See FIG. 7A. The outputs 01, 02, . . . and 08 of the respective stages of the frequency divide circuit 31 are applied to the third data select circuit 32. The third data select circuit 32 is a multiplexer circuit which selects one of the eight inputs by, for instance, three-bit control address. That is, the third data select circuit 32 uses the output signal from the select signal counter 33 as the control address to select one clock signal from the outputs 01 to 08 of the respective stages of the frequency divide circuit 31. FIG. 7(B) shows the operation of the select signal counter 33. The tone generation start (KEY-ON) data from the pressed-key detect and generator assignment circuit 3 is provided, as a clear count start signal, by the control timing generator 35 to the select signal counter 33, which yields output signals corresponding to addresses for sequentially selecting the outputs 01 to 08 of the respective stages of the frequency divide circuit 31. FIG. 7(C) shows the clock signal that is applied, by the select address from the select signal counter 33, from the third data select circuit 32 to the switched capacitor filter circuit 10. After the start of tone generation (KEY-ON) the clock frequency varies in the manner of geometric progression at equal time intervals, producing temporal variations with an exponential characteristic as a whole. This is the filter characteristic that is very effective for synthesizing the timbre of a piano, harpsichord or like musical insturment which contains harmonic components in abundance at the moment of its tone generation. This greatly contributes to the fabrication of the active filter circuit as an LSI which could not have been realized as a timbre operation circuit of a simple circuit arrangement and of digital control.

Figure 8:
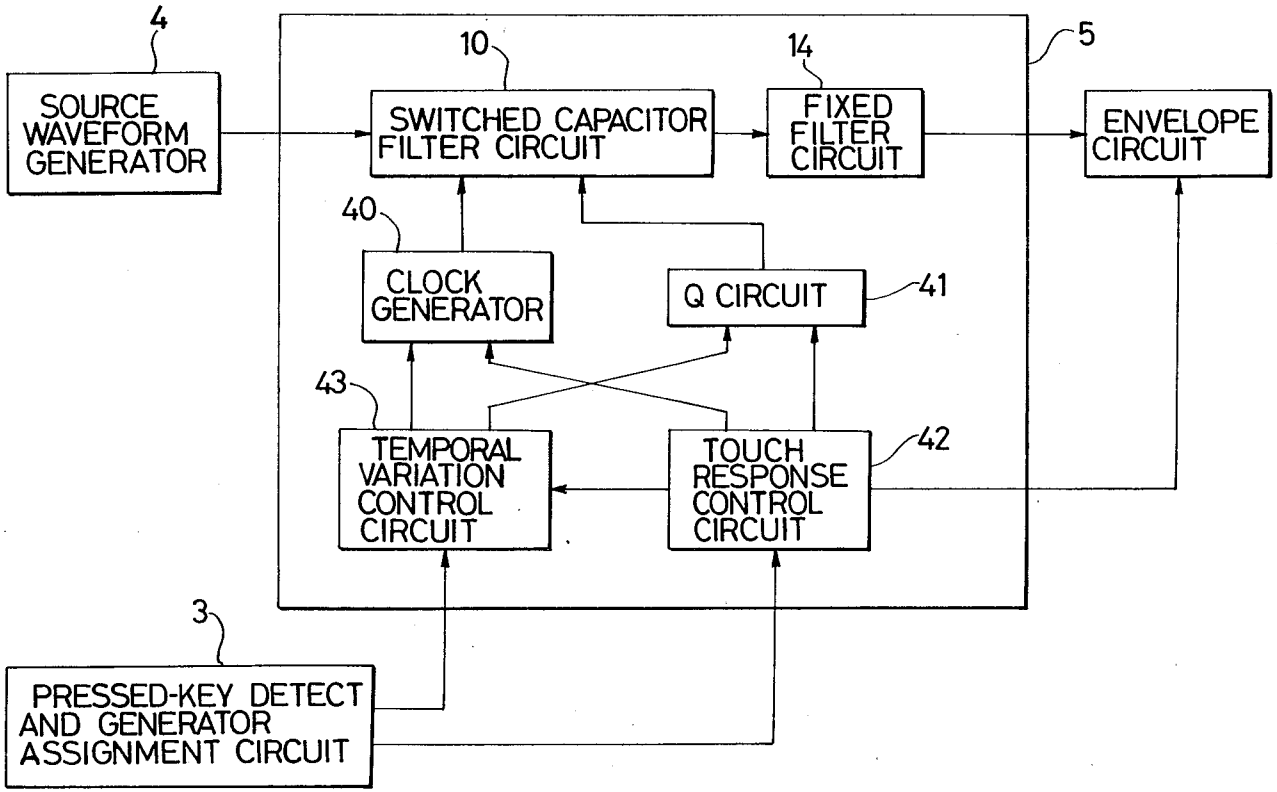
FIG. 8 is a block diagram illustrating another specific operative example of the circuit arrangement including the switched capacitor filter circuit and the control circuits associated therewith which constitute the tone control filter circuit 5 shown in FIG. 1.

FIG. 8 illustrates still another example of the arrangement of the switched capacitor filter circuit and the associated control circuits which are provided in the tone control filter circuit 5 shown in FIG. 1. In FIG. 8, reference numeral 10 indicates a switched capacitor filter circuit; 40 designates a clock generator for generating a clock signal for setting the cut-off frequency of the switched capacitor filter circuit 10; 41 identifies a Q circuit for setting the Q characteristic of the switched capacitor filter circuit 10; 43 denotes a temporal variation control circuit for temporally changing parameters of the clock generator 40 and the Q circuit 41; 42 represents a touch response control circuit for controlling the parameters of the clock generator 40 and the Q circuit 41 and the operation of the temporal variation control circuit 43 in accordance with a touch response; and 14 shows a fixed filter circuit for cutting off sampling noise which is produced in the switched capacitor filter circuit 10.

Figure 9A:
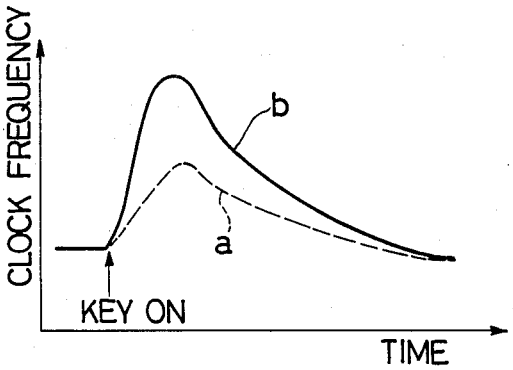
FIGS. 9A–C show graphs explanatory of the operation of the embodiment depicted in FIG. 8.
Figure 9B:
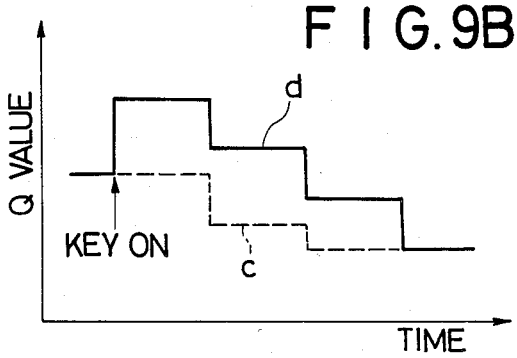
Figure 9C:
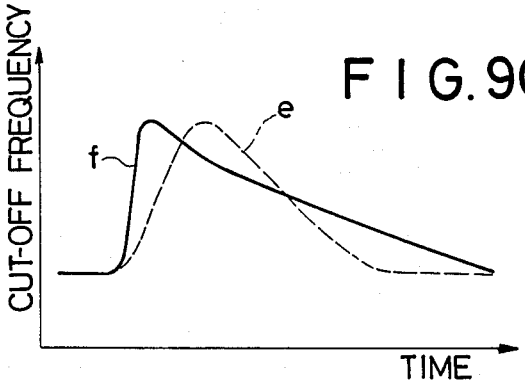

A description will be given, with reference to FIGS. 9A–C, of the operation of the embodiment depicted in FIG. 8. When supplied with rise and fall data of a musical sound signal from the pressed-key detect and generator assignment circuit 3, the temporal variation control circuit 43 successively supplies the clock generator 40 and the Q circuit 41 with digital data corresponding to the temporal variations of the musical sound signal. The clock signal which is produced by the clock generator 40 is intended to set the cut-off frequency of the switched capacitor filter circuit 10 and corresponds to a VCF envelope signal in the conventional VCF type electronic musical instrument. The Q circuit 41 yields a control signal for selecting an analog parameter which constitutes the switched capacitor filter; for example, by selective switching of a plurality of resistors and circuit connections, the Q character data important for the timbre operation is selectively set. On the other hand, the pressed-key detect and generator assignment circuit 3 provides, as touch response data, the strength of a touch on the keyboard to the touch response control circuit 42 for each tone generator. The touch response control circuit 42 applies a volume control signal of the musical sound to the envelope generator 6, as required, and at the same time, controls a touch response operation of timbre in the tone control filter circuit 5. FIG. 9(A) shows an example in which the touch response control circuit 42 responds to the clock signal from the clock generator 40. The curve (a) shows temporal variations of the clock frequency for a soft touch on the keyboard and the curve (b) temporal variations of the clock frequency for a hard touch on the keyboard. The difference in the variation characteristic between the clock frequencies corresponds to the cut-off frequency of the switched capacitor filter circuit 10, so that for the timbre of the musical sound the clock frequency undergoes temporal variations of a characteristic containing harmonics. That is, for the soft touch in the case of the curve (a), not only the volume which is added by the envelope generator 6 is small but also the timbre undergoes striking-sound-like temporal variations a relatively smoothly. On the other for the hard touch in the case of the curve (b), not only the volume which is added by the envelope generator 6 is large but also the timbre contains harmonics over a wide range and undergoes striking-sound-like temporal variations. This well corresponds to the characteritic of a natural musical instrument such as a piano, vibraphone or the like, and is very effective timbre operation function for producing natural musical sounds in the electronic musical instrument. FIG. 9(B) shows an example in which the touch response control circuit 42 responds to the Q factor which is set in the Q circuit 41. The curve (c) shows temporal variations of the Q factor for a soft touch on the keyboard and the curve (d) temporal variations of the Q factor for a hard touch on the keyboard. The difference between the variation characteristics of the Q factor is reflected as the Q factor of the switched capacitor filter circuit 10, and for the timbre of the musical sound, the Q factor undergoes temporal variations of a characteristic containing harmonics. That is, for the soft touch in the case of the curve (c), the peak of the Q factor is low and the timbre undergoes smooth temporal variations, but for the hard touch in the case of the curve (d), the peak of the Q factor is high and the timbre has a formant characteristic peculiar thereto and undergoes temporal variations. This is very effective as a touch response expression which well corresponds to the characteristic of the timbre of such a natural musical instrument as saxophone, a trumpet or the like. FIG. 9(C) shows an example in which the touch response control circuit 42 responds to the temporal variation parameter in the temporal variation control circuit 43, in connection with the cut-off frequency of the switched capacitor filter circuit 10. The curve (e) shows temporal variations of the parameter for a soft touch on the keyboard and the curve (f) temporal variations of the parameter for a hard touch on the keyboard. The difference between the variation characteristics of the paramerter is reflected as a difference between the modes of variation in the cut-off frequency of the switched capacitor filter circuit 10, and for the timbre of the musical sound, the cut-off frequency produces resonance and reverberation owing to the speed of the temporal variations of the characteristic containing harmonics. That is, for the soft touch in the case of the curve (e), the cut-off frequency undergoes relatively fast temporal variations, but for the hard touch in the case of the curve (f), it sharply rises but gradually falls, producing such an effect as if harmonics resonate with strings other than that struck hard. This is very effective as a touch response expression which well corresponds to the characteristic of timbre of a quitar, piano or like natural musical instrument.

As described above, according to the present invention, in the electronic musical instrument which employs a switched capacitor filter circuit for controlling harmonic components of a source waveform signal in accordance with a desired timbre, the filter portion of the electronic musical instrument of the analog sound source system which can be fabricated as an LSI is adapted for digital control, thereby providing a musical sound generating system which varies the musical waveform with time and in accordance with a touch response by a simple arrangement. Accordingly, the present invention offers an electronic musical instrument of high musicality, and hence greatly contributes to the creation of good music.

It will be apparent that many modifications and variations may be effected without departing from the scope of the novel convepts of the present invention.

What is claimed is:

1. An electronic musical instrument comprising:

a source waveform generator for generating a source waveform signal corresponding to a note frequency and containing harmonic components in abundance;

a switched capacitor filter circuit for controlling the harmonic components of the source waveform signal from the source waveform generator in accordance with a desired timbre;

a temporal variation circuit for SCF parameters for temporally varying the filter characteristic of the switched capacitor filter circuit; and a control circuit for digitally controlling the temporal variation circuit;

wherein the temporal variations of a musical waveform signal are controlled digitally, said temporal variation circuit comprising a clock generator for setting a clock frequency corresponding to the cut-off frequency of the switched capacitor filter circuit and a clock varying circuit for varying the clock frequency of the clock generator, whereby temporal variations of the cut-off point of a tone filter is controlled digitally, said clock varying circuit comprising an SCF clock variation memory circuit for storing a plurality of kinds of temporal variation character data of SCF parameters, a switched capacitor filter readout circuit for reading out the temporal variation character data of SCF parameters from the SCF clock variation memory circuit in a sequential order with the lapse of time and a character setting circuit for selecting one of the temporal variation character data in accordance with timbre setting data, and wherein a clock frequency corresponding to the output signal of the readout circuit is propduced by the clock generator, digitally controlling the temporal variations of the musical waveform signal.

2. An electronic musical instrument comprising:

a source waveform generator for generating a source waveform signal corresponding to a note frequency and containing harmonic components in abundance;

a switched capacitor filter circuit for controlling the harmonic components of the source waveform signal from the source waveform generator in accordance with a desired timbre;

a temporal variation circuit for SCF parameters for temporally varying the filter characteristic of the switched capacitor filter circuit; and a control circuit for digitally controlling the temporal variation circuit;

wherein the temporal variations of a musical waveform signal are controlled digitally, said temporal variation circuit comprising a clock generator for setting a clock frequency corresponding to the cut-off frequency of the switched capacitor filter circuit and a clock varying circuit for varying the clock frequency of the clock generator, whereby temporal variations of the cut-off point of a tone filter is controlled digitally, said clock varying circuit comprises binary shift circuits formed by a plurality of stages of frequency divide circuits and a select circuit for sequentially selecting the outputs of the binary shift circuits, and wherein an exponentially varying clock frequency is generated by the clock generator, digitally controlling the temporal variations of the musical waveform signal.

3. An electronic musical instrument comprising:

a source waveform generator for generating a source waveform signal corresponding to a note frequency and containing harmonic components in abundance;

a switched capacitor filter circuit for controlling the harmonic components of the source waveform signal from the source waveform generator in accordance with a desired timbre;

a temporal variation circuit for SCF parameters for temporally varying the filter characteristic of the switched capacitor filter circuit; and a control circuit for digitally controlling the temporal variation circuit;

wherein the temporal variations of a musical waveform signal are controlled digitally, said temporal variation circuit for SCF parameters comprise a Q character data generator for setting Q character data corresponding to the Q character of the switched capacitor filter circuit and a Q character data variation circuit for temporally varying the Q character data of the Q character data generator, and wherein the temporal variations of the A character of a tone filter are digitally controlled.

4. An electronic musical instrument according to claim 3 wherein the Q character data variation circuit comprises a Q character data variation memory circuit for storing a plurality of kinds of temporal variation character data of the Q character data, a readout circuit for reading out the temporal variation character data from the Q character data variation memory circuit and a character data setting circuit for selecting one of the temporal variation character data in accordance with timbre setting data, and wherein a Q character corresponding to the output signal of the readout circuit is generated by the Q character data generator, digitally controlling the temporal variations of the musical waveform signal.

* * * * *